US005413153A

United States Patent [19]

Zwilling et al.

[11] Patent Number: 5,413,153

[45] Date of Patent: May 9, 1995

[54] CONTAINER FILLING MACHINE FOR FILLING OPEN-TOP CONTAINERS, AND A FILLER VALVE THEREFOR

[75] Inventors: Heinz-Michael Zwilling, Hamm; Siegmar Sindermann, Kamen; Axel Theine, Wöllstein, all of Germany

[73] Assignee: KHS Maschinen- und Anlagenbau AG, Dortmund, Germany

[21] Appl. No.: 192,688

[22] Filed: Feb. 7, 1994

[30] Foreign Application Priority Data

Feb. 6, 1993 [DE] Germany ..... 43 03 524.8

[51] Int. Cl.[6] ..... B67C 3/26; B65B 55/10

[52] U.S. Cl. ..... 141/39; 141/48; 141/40; 141/302

[58] Field of Search ..... 141/6, 39–42, 141/46–49, 51, 59, 60, 290–294, 301–303

[56] References Cited

U.S. PATENT DOCUMENTS

| | | | |
|---|---|---|---|
| 4,089,353 | 5/1978 | Antonelli | 141/302 |
| 4,442,873 | 4/1984 | Yun | 141/39 |
| 4,679,603 | 7/1987 | Rademacher et al. | 141/39 |
| 4,938,261 | 7/1990 | Petri et al. | 141/39 |
| 4,989,650 | 2/1991 | Weiss | 141/6 |
| 5,042,536 | 8/1991 | Petri et al. | 141/39 |
| 5,125,440 | 6/1992 | Mette | 141/39 |
| 5,150,740 | 9/1992 | Yun | 141/6 |

FOREIGN PATENT DOCUMENTS

| | | | |
|---|---|---|---|
| 2126113 | 11/1972 | Germany . | |
| 3725609 | 2/1989 | Germany . | |
| 1092830 | 11/1967 | United Kingdom | 141/39 |

*Primary Examiner*—J. Casimer Jacyna

*Attorney, Agent, or Firm*—Nils H. Ljungman & Associates

[57] ABSTRACT

A container filling machine for filling beverages into containers has a filler valve configured for allowing the valve to operated by a simplified control system. The valve has a valve body and a gas pipe disposed concentrically therewith, wherein there is a first spring for applying a biasing force between the gas pipe and the valve body to bias the valve body to its closed position, and a second spring, which when compressed by a control cam when there is a container present provides a force sufficient to overcome the biasing force of the first spring and thereby open the valve. In the absence of a container, the control cam for opening the valve body is able to run through its normal operation cycle without causing the valve to be opened because the gas pipe is configured to hold the valve body closed under a force applied by pressurized gas in the filling machine.

18 Claims, 3 Drawing Sheets

CONTAINER FILLING MACHINE FOR FILLING OPEN-TOP CONTAINERS, AND A FILLER VALVE THEREFOR

BACKGROUND OF THE INVENTION

1. Field of the Invention

This invention generally relates to a filler valve for a container filling machine, and more particularly, to a filler valve for a machine for filling beverages into containers such as bottles, cans etc. under a counterpressure. The filling machine can have a tank or reservoir which contains the filler valve therein. The filler valve has a valve closing body for opening and closing a fluid filling passage, and a gas, or vent pipe which can be raised and lowered and is guided inside the valve closing body. Such a filler valve can also have a centering bell which can be raised and lowered independently of the gas pipe to seal the mouth of the container to be filled against the surrounding atmosphere. The control movements of the valve, or of the movable parts of the valve, can be initiated at least partly by a rotary pinion gear, which rotary pinion gear can be actuated from outside the tank, or reservoir, by means of control cams.

2. Background Information

Such a filler valve is disclosed, for example, in German Laid Open Patent Application No. 2 126 113. That filler valve disclosed therein is a valve for filling beverage cans, whereby the liquid to be filled is under pressure, and a corresponding counterpressure is also established in the can to be filled. For this purpose, first the can is primed to the pressure prevailing in the reservoir, and after the pressure has been equalized, the filler valve, strictly speaking, is opened, so that the liquid in the reservoir, or tank, can flow into the can, under the influence of the geodetic gradient, or simply gravity flow. During the filling process, the liquid ascends to the lower opening of the gas, or vent pipe, whereupon the remainder of the filling process stops automatically, because there can be no reverse exchange of gas from the container or can back into the reservoir. At this juncture, there can typically be a release of the pressure in the can, which can then be removed from the filler valve and closed.

In this known filling apparatus, the can can be sealed to the filling element by means of a centering bell, which works with a differential pressure chamber, and by means of the differential pressure chamber, the bell gasket is pressed against the mouth of the container during the filling process. On this can filler valve, the gas pipe is guided so that it can move inside the filler valve body. However, the gas pipe has a rigid connection to the centering bell, so that the end of the gas pipe always projects a certain distance beyond the lower edge of the centering bell as a function of the desired filling level. Consequently, the stroke movement of the centering bell must be greater by at least this projecting distance of the gas pipe, so that during the introduction of the can under the centering bell or under the filling element, a certain space is left open between the bell or the lower edge of the gas pipe and the upper edge of the can. This larger space leads to undesirably large pressure reduction volumes.

On another can filler valve, as disclosed in German Laid Open Patent Application No. 37 25 609, which valve also works with a differential pressure chamber, the gas pipe is mounted independently of the centering bell which can be moved up and down, so that only a small stroke movement is necessary to lower the centering bell. However, on this valve, the final lowering of the gas pipe into the lower position is done by opening, or lowering the closing body. Therefore, during the closing, or raising of the filler valve, the gas pipe is also raised by the amount of the closing stroke, and a subsequent change of the final fill level is thereby effected as additional air can then leave through the gas pipe, thereby allowing additional fluid to flow into the can. Movement of the gas pipe is thereby actuated by a piston-cylinder system, and the movement of the filler valve body is executed by an externally actuated fork of a pinion gear control.

OBJECT OF THE INVENTION

Starting from the filler valves as described hereabove, the object of the present invention is to improve the design of a filler valve, and to create a simplified control system for the valve, without requiring a piston-cylinder system.

SUMMARY OF THE INVENTION

The present invention teaches that this object can be achieved with a filler valve of the type described above, on which there is a first spring which braces the gas pipe and the valve closing body at some distance from one another, whereby the gas pipe, in one position, is held in contact with an upper stop of the valve closing body. The present invention also provides a second spring with greater prestress than the first spring, which second spring preferably provides the force needed to open the valve body when a container is present therebelow. With the spring arrangement in accordance with the present invention, the gas pipe, when there is a downward rotation of the control cam, is moved by the first spring into its lower limit position, whereby the valve body remains in the closed position. Then, upon a further rotation of the control cam to act on, or compress, the second spring against the force of the first spring, the valve body can be moved into the open position. In other words, the valve closing body can be brought into the open position by spring assist and by the rotational movement of the control cam.

In an independent configuration, the present invention also teaches that the valve closing body can be held in the closed position, for example, when a container is not present therebelow, by the internal pressure in the tank acting on a sealing body of the gas pipe by means of a spring-assisted stop connection with the gas pipe. In other words, the gas pipe can be held in its uppermost position by means of the pressure within the tank, and thus, by means contacting stop flanges on both the gas pipe and the valve body, the valve body can not move downward under the force of the second spring.

With such a configuration, when a container filling operation is completed and the control cam releases the pressure on the second spring, the gas pipe will typically remain in the lower stop position by means of the pressure forces acting on the gas pipe. As such, the first spring can then execute the closing motion of the valve body.

The present invention also teaches that as the control cam executes a further stroke movement after releasing the pressure on the second spring, the control cam can come into contact with the lower end surface of a sealing body or another stop of the gas pipe, and can thereby move the sealing body into contact against the inner top surface of the ring-shaped tank.

One additional characterizing feature of the present invention provides that the sealing body of the gas pipe, after the reduction of the pressure in the gas space in the filled container, can be held in the upper position by the internal reservoir pressure acting on the surfaces of the sealing body.

In the upper stop position of the sealing body, that is, against the inner top surface of the tank, there can preferably be a connection between the gas pipe and the priming, or preloading, valve. The priming of the container interior can then be initiated by closing a flush valve.

In addition, in this upper stop position of the gas pipe, the gas pipe can, if desired, be provided with a connection to a feed line of a toroidal chamber for a sterilization medium. This sterilization chamber can be designed as part of the circular fluid tank, or alternately, if the heat of the sterilization chamber would adversely affect the fluid in the fluid tank, the sterilization chamber can preferably be positioned at some distance from the fluid tank, and can be isolated from the fluid tank by some sort of insulation.

In contrast to the known filler valves, the filler valve claimed by the present invention has significant advantages in the sequence of control processes. For example, when there is no container present below the filler valve, there is no need to have individual actuation of the valves, since, as discussed briefly above, if there is no container present the valve closing body will not open. Furthermore, as a result of specified upper and lower stops, it becomes possible to achieve exact positionings of the individual parts of the filler valve, both individually and in relation to one another. Furthermore, by eliminating a piston-cylinder system for movement of the gas pipe, it becomes possible to significantly improve the cleaning of the entire filler valve in the circulation system. The springs required for control are also located above the filling level of the fluid in the tank, or reservoir.

In summary, one aspect of the invention resides broadly in a container filling machine for filling liquid into containers, the containers having an interior space, the container filling machine having a liquid supply, and the filling machine comprising: apparatus for receiving a container, the apparatus for receiving a container comprising seal apparatus for sealing the interior space of a container from the surrounding atmosphere; apparatus for moving one of: the apparatus for receiving, and a container, towards and away from the other of: the apparatus for receiving, and a container to respectively engage and disengage the seal apparatus and a container; fill conduit apparatus interconnecting the liquid supply with a container sealed to the apparatus for receiving, the conduit apparatus being configured for conducting liquid from the liquid supply to the container sealed to the apparatus for receiving; a valve body for opening and closing the conduit apparatus to respectively permit and stop liquid flow into the container; apparatus for operating the valve body to open and close the conduit apparatus; the valve body comprising a gas exchange tube for at least conducting gas out of the container as liquid flows into the container; the gas exchange tube being configured to be movable relative to the valve body, and the gas exchange tube comprising first biasing apparatus for biasing the valve body into its closed position with a first biasing force; and the apparatus for operating the valve body comprising: apparatus for overcoming the first biasing force to open the valve body in the presence of a container sealed to the apparatus for receiving; and apparatus for maintaining the valve body in a closed position in the absence of a container sealed to the apparatus for receiving.

Another aspect of the invention resides broadly in a filling valve for a container filling machine for filling liquid into containers, the containers having an interior space, the container filling machine comprising a reservoir to contain liquid therein with a gas headspace above the liquid, apparatus for supporting containers to be filled relative to the reservoir, and apparatus for providing a gas to purge a container to be filled, the filling valve comprising: fill conduit apparatus configured for interconnecting the reservoir with a container to be filled; a valve body for opening and closing the conduit apparatus to respectively permit and stop liquid flow into a container; the valve body comprising a gas exchange tube for conducting gas into and out of a container; the gas exchange tube having a first end disposed adjacent a container to be filled, and a second end disposed within the reservoir; the gas exchange tube being configured to be movable relative to and independently of the valve body between a first position and a second position; the gas exchange tube in the first position comprising the second end thereof in communication with the apparatus for providing a purging gas to purge the container to be filled; and the gas exchange tube in the second position comprising the second end in communication with the gas headspace for venting gas out of a container being filled into the headspace of the reservoir during liquid flow into the container being filled.

A still further aspect of the invention resides broadly in a filling valve for a container filling machine for filling liquid into containers, the containers having an interior space, the container filling machine comprising a reservoir to contain liquid therein with a gas headspace above the liquid, apparatus for supporting containers to be filled relative to the reservoir, the filling valve comprising: fill conduit apparatus interconnecting the liquid supply with a container sealed to the apparatus for receiving, the conduit apparatus being configured for conducting liquid from the liquid supply to the container sealed to the apparatus for receiving; seal apparatus for sealing a container to be filled to the fill conduit apparatus; a valve body for opening and closing the conduit apparatus to respectively permit and stop liquid flow into the container; apparatus for operating the valve body to open and close the conduit apparatus; the valve body comprising a gas exchange tube for at least conducting gas out of the container as liquid flows into the container; the gas exchange tube being configured to be movable relative to the valve body, and the gas exchange tube comprising first biasing apparatus for biasing the valve body into its closed position with a first biasing force; and the apparatus for operating the valve body comprising: apparatus for overcoming the first biasing force to open the valve body in the presence of a container sealed to the conduit apparatus; and apparatus for maintaining the valve body in a closed position in the absence of a container sealed to the conduit apparatus.

BRIEF DESCRIPTION OF THE DRAWINGS

The invention is explained in greater detail below, with reference to the embodiments illustrated in the accompanying drawings, in which.

DESCRIPTION OF THE PREFERRED EMBODIMENT

Figure 1:
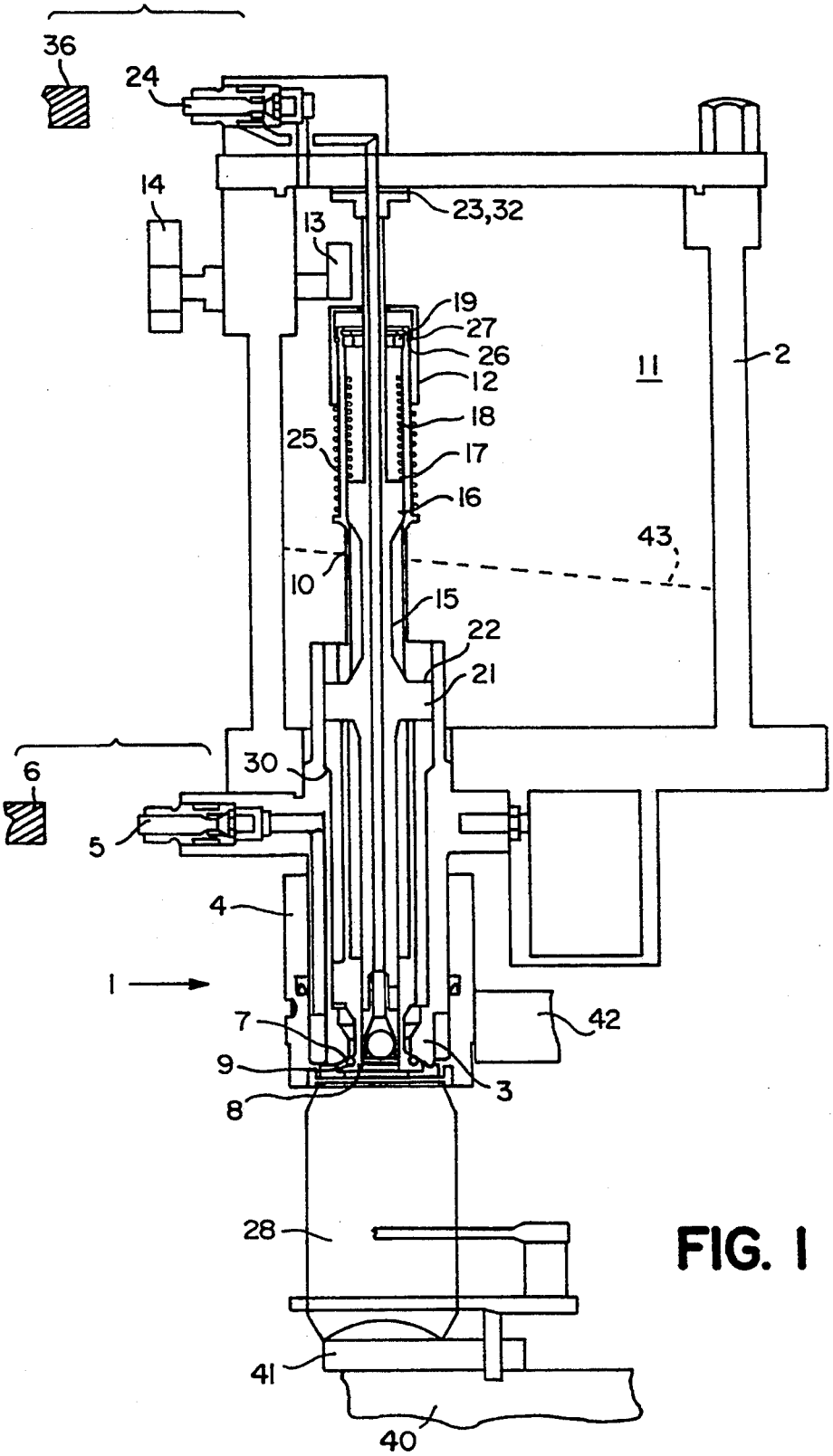
FIG. 1 shows the filler valve in the closed position.

For the following discussion, it should be generally understood that the filling machine has an overall cylindrical appearance, wherein a fluid reservoir 2 having a generally toroidal shape can define at least an outer circumference of the filling machine. FIG. 1 shows a cross-sectional view through an outer circumferential portion of what could be called a filling station of such a filling machine. In essence, a plurality of such filling stations as depicted in FIG. 1 can be located, essentially side by side, and along substantially the entire periphery of the filling machine. Below each filling station, there can typically be a turntable 40 which rotates along with the filing machine, and which turntable can have a number of support plates 41 for supporting, with respect to each filling station, a container 28 to be filled. The general mode of transport of containers is essentially well known, as shown by some of the patents listed herebelow, and therefore is not discussed in any more detail herein.

In the embodiment illustrated in FIG. 1, filler valve 1 is located on a ring-shaped reservoir 2 of a rotating filling machine, not illustrated in any greater detail in a circular sequence. The filler valve 1 has a bottom housing 3, on which a centering bell, or tulip, 4 with a contact gasket can be raised and lowered. Mechanisms for raising and lowering such a centering bell, depicted only schematically as 42 in FIG. 1, can include a cam and a cam follower, which are generally well known as shown by some of the patents listed herebelow, and are therefore not discussed in any further detail herein.

The housing 3 can preferably be configured with a flush valve 5, which can be opened one or more times by control rails 6 as a function of the desired process. Control of such valves 5 is also generally known as shown by some of the patents listed herebelow, and is therefore also not discussed in any further detail herein.

On the lower end of the housing 3, there can preferably be a sealing arrangement (not shown in any detail) for sealing the housing 3 to a container 28. The lower end of the housing 3 can also have a valve seat 7, with which the valve closing body 8 with its gasket 9 are in contact when the filler valve is closed. The valve closing body 8, as shown, has a tubular extension 10 which can extend into the upper space 11 of the toroidal fluid reservoir 2, that is, above the surface 43 of the liquid. By means of the extension 10, the valve closing body 8 can be moved downwardly into an open position to allow fluid to flow therethrough and into a container sealed to the housing. This movement, as discussed in more detail further below, can preferably be brought about by means of a control cam 13 of a control pinion 14 which can act on a pressure sleeve 12, with a corresponding spring 25, disposed about the extension 10.

A gas pipe 15 can preferably be located inside the valve closing body 8 and can preferably extend through the extension 10. In its central portion, the gas pipe 15 can preferably have an enlargement 16, which can also be designed as a plastic bushing. This bushing, or enlargement 16 can preferably be configured for guiding the extension 10 therearound. A first biasing device, such as spring 18 can have a lower end 17 braced against this enlargement 16. An upper end of this spring 18 can be braced against a portion of the extension 10, which portion of the extension 10, as shown in the figures, can be an inner ring 19 disposed circumferentially within the extension 10. In this manner, the valve closing body 8 and the gas pipe 15 can be biased against one another, that is, in opposite directions to one another. Also, because movement of the gas pipe 15 and closing body 8 generally are dependent on the prevailing pressure within the reservoir 2, pressure differentials, and pressure force acting on surface areas of different sizes for each of the closing body 8 and gas pipe 15, the spring 18 can also assist in the application of forces needed to provide a proper operating sequence of the valve parts. As such, the valve closing body 8 can be held in the closed position, even when the priming valve 24 is open. With the mutual prestressing of the extension 10 of the valve closing body 8 with the gas pipe 15, webs 21 of the gas pipe 15 can be held in contact with correspondingly configured webs 22 of the extension 10. Consequently, the valve closing body 8 can be held in the closed position.

At the upper end of the gas pipe 15, that is, the end opposite the valve closing body 8, there can preferably be a sealing body 23 which can be moved by the control cams 13 of the control pinion 14 into the upper position against the top plate of the reservoir 2. Once the sealing body 23 is in this upper, sealed position, the sealing body can essentially be held in place by means of the overpressure within the reservoir 2. In other words, the overpressure within the reservoir 2, because of the larger lower surface area of the sealing body 23, will push the sealing body 23 into engagement with the top plate of the reservoir 2. When the gas pipe 15 is in the upper position as shown in FIG. 1, a direct connection to the priming valve 24 can then be established.

In this closed position of the filler valve 1, the pressure sleeve 12 can be held in the upper position by means of a second biasing device, such as the second spring 25, as briefly mentioned previously. This second spring 25 can preferably have a greater prestress than that of the first spring 18, and when the cam 13 is rotated out of contact with the pressure sleeve 12, a projection 26 of the sleeve 12 can be biased into contact with a stop 27 of the extension 10 of the valve closing body Further descriptions of the components of the present invention are set forth herebelow with regard to the operation of the apparatus of the present invention in carrying out a filling operation of a container. It should be understood that, as the following process steps are being performed, the filling machine and containers are being moved along a generally circular path defined by the filling machine, and operation of certain valve components are typically carried out by means of fixed camming devices disposed about the periphery of the filling machine.

Figure 1A:
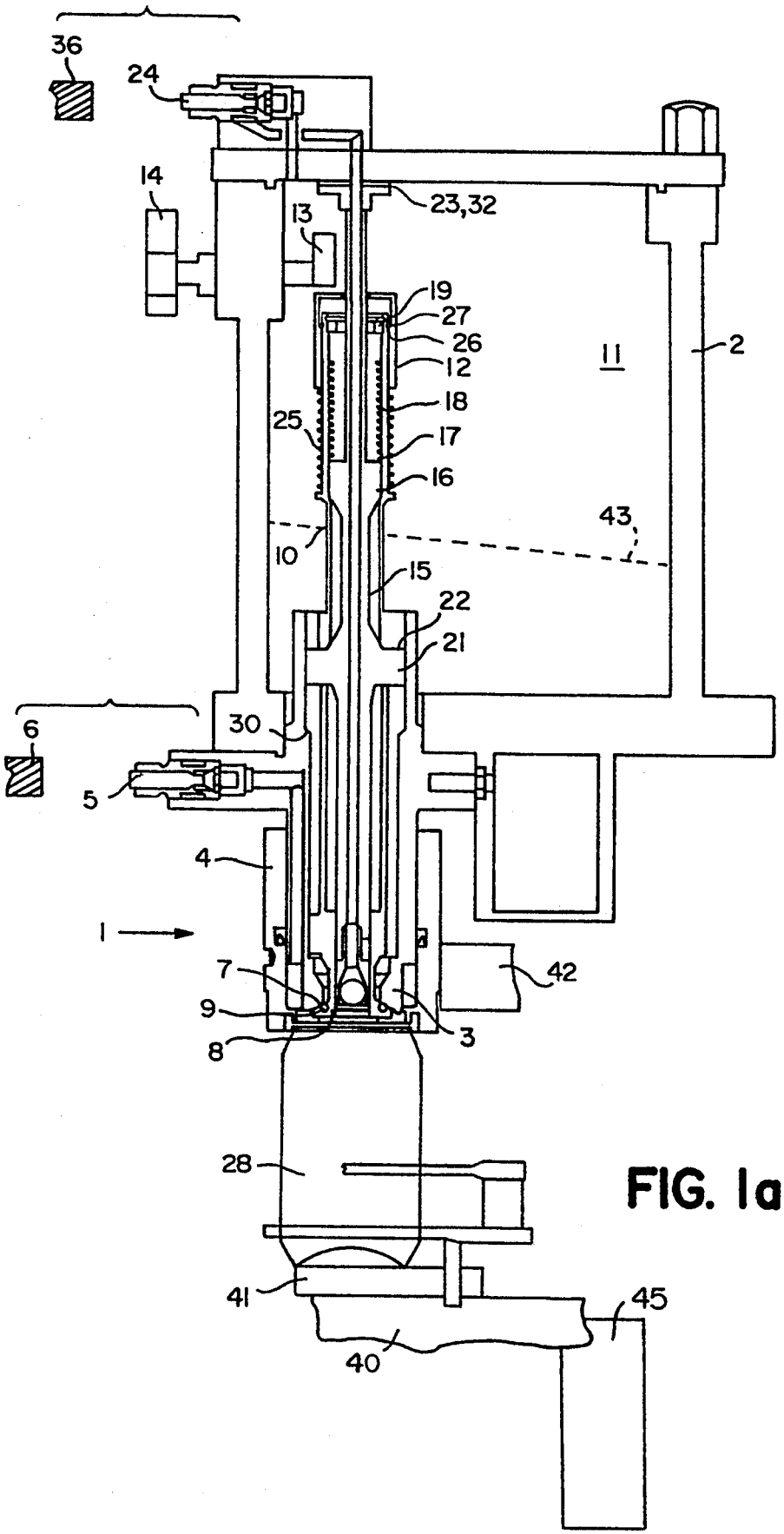
FIG. 1*a* shows an alternative embodiment of a filler valve.

To fill a container 28 with the liquid under pressure in the reservoir 2, first a container 28 is moved by a feed star wheel (not shown) or other similar device onto a support plate 41 under the ring-shaped reservoir and into position under a corresponding filler valve 1, which is then located in the container intake area. The centering bell 4 with its application gasket is then lowered over the mouth of the container 28 by guide rollers and cam rails which are not shown in any further detail. Alternately, as schematically represented by apparatus 45 in FIG. 1*a*, apparatus could be provided to raise the container 28 into contact with the centering bell 4, and thus, in the broadest concept, at least one of the centering bell 4 and the container 28 can be moved towards the other of the centering bell 4 and the container 28 so that a seal can be established about the mouth of the container 28. The interior of the container 28 is then essentially sealed from the surrounding atmosphere.

As soon as a seal has been established, the filling, per se, can be initiated. In the initial stages of the filling process, the apparatus and beverage container will therefore be in positions as represented by FIG. 1, with the gas pipe raised all the way to the upper plate of the reservoir 2, and the valve body 8 in a closed position. As an initial step of the filling process, if a flushing operation is desired, the flush valve 5 can be opened, and the priming valve 24 can be actuated by a cam rail 36. The priming valve 24 can then be operated to provide a short circuit with the pressurized reservoir gas, or can connect to an alternate fresh gas supply, such as a pressurized carbon dioxide source. The flushing process can then be initiated, whereby the pressurized gas can flow through the valve 24, down the gas pipe 15, into the container, and then out the open flush valve 5.

Figure 2:
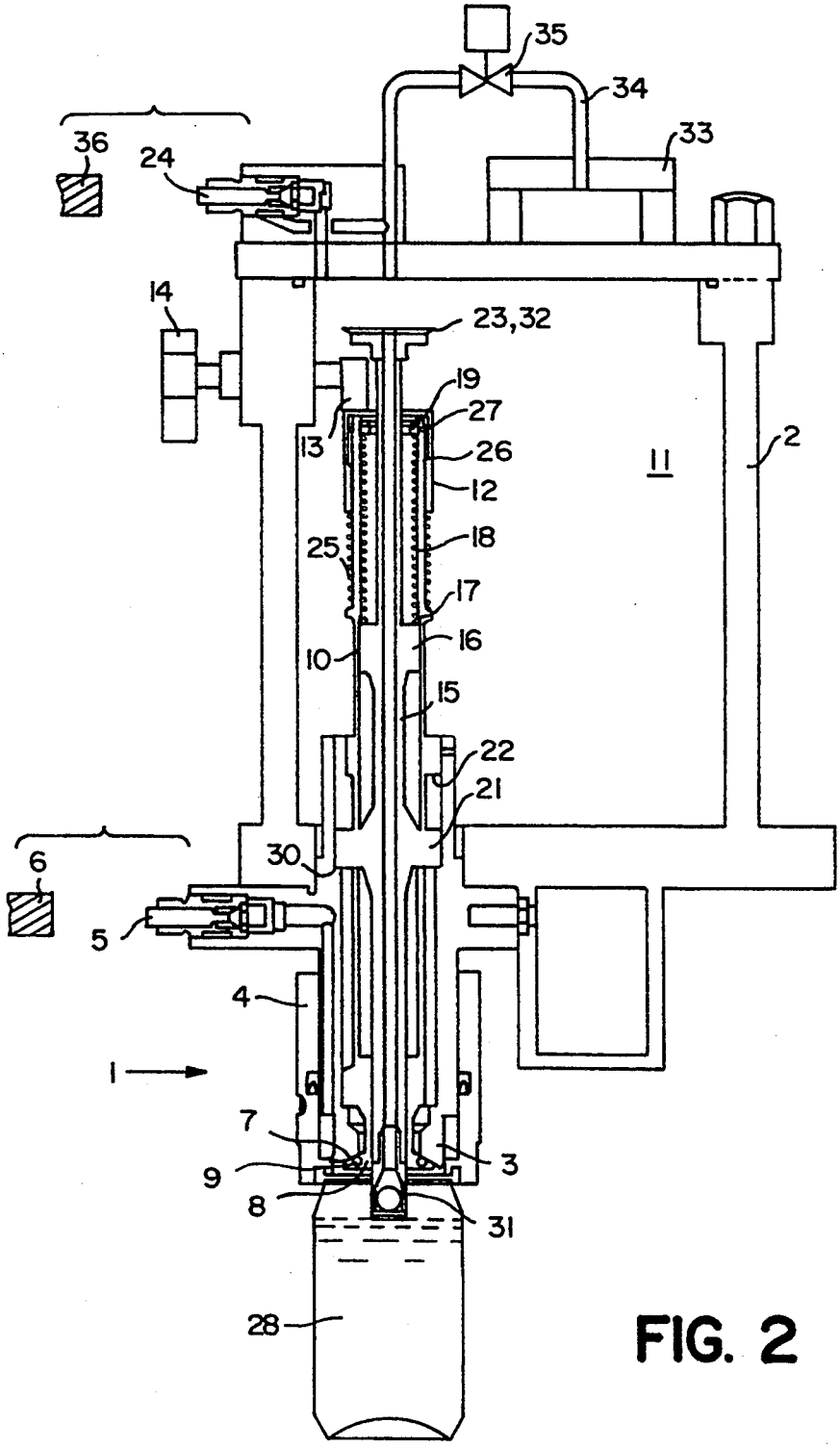
FIG. 2 shows the filler valve in the open position and one variant of the filler valve with feed lines for sterilization measures.

If it is considered necessary, or desirable, there can also be a corresponding evacuation of the inside of the container, or a corresponding disinfection, steam sterilization etc. As shown in FIG. 2, there can be an additional toroidal chamber 33 located above the actual toroidal reservoir 2, with feed lines which can be used to supply a sterilization agent, e.g. sterilized air, steam etc., and which can have a direct connection to the gas pipe 15 by means of the feed lines 34. As an alternative to operation via the valve 24, such a system can alternately be actuated by means of special control valves 35. Further details regarding such a sterilization system, etc, and the operation of the valves is not provided herein as such is deemed to be well known as shown by some of the patents listed herebelow.

As soon as the various preparatory and/or sterilizing measures of the inside of the container have been completed, the priming of the interior of the container to the internal pressure prevailing in the filling machine reservoir can then take place. For this purpose, the flush valve 5 can preferably be closed, and the priming valve 24 can then be opened to provide a short circuit with the pressurized interior of the reservoir 2. In this manner, an equalization of the pressure in the container 28 with the prevailing pressure in the reservoir 2 can take place.

After the gas pressure equalization has occurred, the rotary pinion gear 14 can then be actuated by contact with a cam rail, whereby any pressure of the cam 13 pressing the sealing body 23 upwardly can be released. The gas pipe 15 will then typically move downward by the prestress of the inner spring 18. After travelling a short distance, the webs 21 then come into contact with their lower end surface against a stop 30 on the housing 3, whereupon the lower limit position of the gas pipe 15 is reached. This position is illustrated in particular in FIG. 2.

As a further explanation for the above discussed downward movement of the gas pipe 15, one should generally again consider the gas pressure forces acting on the different surface areas of the gas pipe 15 and the valve body 8. In essence, for the spring 18 to move the gas pipe 15 downwardly, the valve body 8 and extension 10 should preferably remain in their closed, or farthest raised position. This will essentially be true, as the gas pressure in the container 28 is essentially the same as the pressure inside the reservoir 2. Thus, because of the larger surface area on the underside, or container side of the valve body 8, the pressure force acting upwardly on the valve body 8 from the container side is typically greater than any pressure force acting downwardly on the valve body 8 from the reservoir side. Thus, the valve body 8 can remain tightly closed, and the spring 18 can bias the gas pipe 15 downwardly to lower the gas pipe 15 into the container as depicted in FIG. 2.

By means of further actuation of the rotary pinion gear 14, the control cam 13 can reach the upper end surface of the pressure sleeve 12. Then by applying a camming pressure against the top of the pressure sleeve 12, the pressure sleeve 12 can be displaced downwardly, and can act, or compress the outer spring 25. Then once a sufficient pressure has been applied by the cam 13, via the spring 25 to the valve body 8, that is a pressure sufficient to overcome the gas pressure force acting to hold the valve body 8 closed, as well as the biasing force of the inner spring 18, an opening of the filler valve 8 can occur. This opening of the valve body 8 can essentially occur because the outer spring 25 has a greater prestress than the inner spring 18.

If desired, once the opening of the valve body 8 has been effected, the control cam 13 can continue to travel a slight extra distance, and the control cam can then be maintained in this position until the liquid has filled the container 18. Once opened, the liquid in the ring-shaped reservoir 2 can now flow under the effect of the geodetic, or gravitational gradient into the container 28. As the liquid flows in around the valve body 8, the gas present in the container can exit via the gas pipe 15 into the upper portion 11 of the reservoir 2. As shown in FIG. 2, with the end 31 of the gas pipe 15 in its lower position, the end 31 of the gas pipe, while allowing gas to escape from the container into the air space above the reservoir, can also be simultaneously responsible for determining the level to which the liquid is to be filled in the container 28. In other words, once the level of liquid in the container 28 reaches the lower end 31 of the gas pipe 15, no additional gas exchange with the reservoir is possible, and in this manner the final fill level can be established. In one possible embodiment of the end 31 of the gas pipe 15, the end 31 could contain a float valve, which has a float therein that blocks the gas pipe 15 once the level of the liquid rises sufficiently to raise the float into the opening of the gas pipe 15.

Once the container is filled, and upon a further movement of the container about the path defined by the filling machine, the control cam 13 of the rotary pinion gear 14 can once again be moved upward. The pressure sleeve 12 with its stopping edge thereby moves toward the stop ring 27, so that the outer spring 25 becomes inactive, that is, the pressure of the outer spring 25 on the pressure sleeve 12 is alleviated. Once this pressure on the spring 25 is alleviated, the closing process for the valve closing body 8 is essentially automatically initiated.

While the cam 13 has released the pressure of the outer spring 25, the gas pipe 15 will still remain in its lower stop position, as a function of the pressures in the system, and the inner spring 18 will typically exert the force required to raise and thereby close the valve closing body 8. After a short idle stroke, the upper portion of the control cam 13 then comes into contact with the lower end surface of the sealing body 23 and upon further movement of the cam 13, the cam 13 thereby also moves the gas pipe 15 to the stop 22 of the extension 10 of the valve closing body 8 and thus into the upper stop position. In this upper position, the gasket 32 thereby comes into contact against the inner top surface of the reservoir interior and simultaneously creates a connection to the priming valve 24.

Once the valve body 8 and the gas pipe 15 are returned to their upper position, a depressurization of the inside of the container above the surface of the liquid can then be accomplished by opening the flush valve 5. Finally, after the centering bell 4 has been raised, the filled container can be removed from the filling machine.

As discussed previously, the embodiment illustrated in FIG. 2, shows an optional configuration of the filling machine wherein there can be an additional toroidal chamber 33 located above the actual toroidal reservoir 2. This additional chamber 33 can have feed lines which can be used to supply a sterilization agent, e.g. sterilized air, steam etc., and can have a direct connection to the gas pipe 15 by means of the feed lines 34, which can be appropriately actuated by means of special control valves 35.

In particular with sterilization means supplied at an elevated temperature, the toroidal chamber 33 could alternately be located at a certain distance from the toroidal reservoir 2, and insulation could be disposed between the chamber 33 and the reservoir 2 to prevent a transmission of heat to the toroidal reservoir 2 and/or to the liquid being filled into the containers.

One of the biggest advantages which is provided by the present invention lies in the ability to essentially eliminate an additional device for determining whether a container 28 is located beneath a filler valve 8, and thereby also eliminate any additional operational controls which may be different from the normal operational controls when a container 28 is present. In essence, the apparatus provided by the present invention can follow the same operational controls both with and without a container being present, thereby significantly simplifying the operation of the filling machine.

With the embodiment of the present invention as discussed above, if there is no container 28 to be filled, located below the centering bell 4, a sealed chamber is not established at the fill end of the centering bell. Thus, when the normal pressurization step occurs, for example, when the valve 24 connects the gas tube 15 with the pressurized interior of the reservoir 2, there will not be an increase in the pressure underneath the filler valve. Thus, since the gas pressure inside the reservoir 2 that is acting to push the sealing body 23 upwards to the upper plate of the reservoir 2 is greater than the atmospheric pressure existing within the gas pipe 15 and below the centering bell 4, the application force of the gasket 23 remains fully intact. Thus the web 21 remains in firm contact against the stop 22 of the extension 10 of the valve body 8. Then, when in the normal order of operation, the cam 13 depresses the sleeve 12 against the force of the spring 25, the filler valve can remain closed. In essence, the force of the compressed spring 25 is not sufficient to overcome the force of the gas pressure holding the gas pipe 15 in place.

In essence, although the pinion gear 14 will still pivot into the open position, and thus exert a force on the sleeve 12 and the spring 25, the valve body 8 can remain in the closed position on account of the pressure difference between the pressure inside the reservoir and the external pressure, Therefore, there is essentially no need for a special actuation system for the rotary pinion 14 to alter the operation of the cam 13 when a container is not present below the filling valve 8.

The present invention provides an additional advantage in that the lowered position of the gas pipe 15 provides the filling level of the container, and once the filling level has been reached, and the valve body 8 closed, no additional liquid is added to the container. This, as stated previously can be accomplished by means of the float, or check valve disposed in the lower end of the gas pipe 15, which can block fluid from entering into the gas pipe 15. In some known filling machines, such as some of the filling machines described by the patents listed herebelow, the fluid enters up the gas pipe 15 to the level of fluid in the reservoir. Then after the valve is closed, this fluid is purged from the gas pipe in to the container, thereby affecting the level of fluid in the container. It can easily be seen that the amount of fill in such a known system is therefore dependent on the fluid level in the filling reservoir. Therefore, with the present invention, since essentially no fluid can enter the gas pipe 15, a purging of the gas pipe 15, along with any additional devices for carrying out the purging, are not needed to empty the gas pipe 15, and the level of fluid in each container can essentially always be constant.

One additional advantage of the present invention over the known systems is that the gas pipe 15 can be used as the passage for purging the container with gas, and for sterilization etc. as discussed above. The configuration of the present invention enables the thereby essentially eliminates any other complicated valving and passages which have previously been used to supply the purging gas and the sterilization etc. In essence, with the present invention, only a simple, short and straight bore needs to be made in the top of the reservoir for connecting the gas pipe to any additional gas supplies.

One feature of the invention resides broadly in the filler valve for a container filling machine, in particular for filling beverages into containers such as bottles, cans etc. under counterpressure, whereby the filler valve has a gas pipe which can be raised and lowered and is guided inside a valve closing body, as well as a centering bell which can be raised and lowered independently of the gas pipe to seal the mouth of the container against the surrounding atmosphere, and the control movements of the valve or of the movable parts of the valve can be initiated at least partly by a rotary pinion gear which can be actuated from outside the reservoir which contains the filler valves by means of control cams, characterized by the fact that there is a first spring 18 which braces the gas pipe 15 and the valve closing body 8 at a distance from one another, whereby the gas pipe 15 is in contact with an upper stop of the valve closing body 22, and a second spring 25 with greater prestress than that of the first spring 18, and when there is a downward rotation of the control cam 13, the gas pipe 15 is moved by the first spring into its lower limit position, whereby the valve body 8 remains in the closed position and can be moved by the action of the control cam 13 on the second spring 25 into the open position against the force of the first spring 18.

Another feature of the invention resides broadly in the filler valve characterized by the fact that the valve closing body 8 is held in the closed position by the internal reservoir pressure acting on a sealing body 23 of the gas pipe 15 by means of a spring-assisted stop connection with the gas pipe 15.

Yet another feature of the invention resides broadly in the filler valve characterized by the fact that when the load on the second spring 25 is alleviated, and while the gas pipe 15 remains in the lower stop position, the first spring 18 exerts the force required for the closing motion of the valve body 8.

Still another feature of the invention resides broadly in the filler valve characterized by the fact that when there is a further stroke movement of the control cam 13, the control cam can be applied against the lower end surface of a sealing body 23 or against another stop of the gas pipe 15, and the sealing body 23 moves toward the inner end surface of the toroidal reservoir 2.

Another feature of the invention resides broadly in the filler valve characterized by the fact that the sealing body 23 of the gas pipe 15, after the reduction of the pressure in the gas chamber, is held in the upper position by the internal reservoir pressure.

Yet another feature of the invention resides broadly in the filler valve characterized by the fact that in the upper stop position of the sealing body, there is a connection to the priming valve.

Still another feature of the invention resides broadly in the filler valve characterized by the fact that the priming of the container interior can be initiated by closing a flush valve 5.

Another feature of the invention resides broadly in the filler valve characterized by the fact that the valve closing body 8 can be brought into the open position by spring assist and by the rotational movement of the control cam 13.

Yet another feature of the invention resides broadly in the filler valve characterized by the fact that the gas pipe 15 can be connected in the upper stop position to the feed line 34 of a toroidal chamber 33 for a sterilization medium.

Still another feature of the invention resides broadly in the filler valve characterized by the fact that the sterilization medium toroidal chamber 33 is designed as part of the toroidal reservoir 2.

Another feature of the invention resides broadly in the filler valve characterized by the fact that the sterilization medium toroidal chamber 33 is held at some distance from the toroidal reservoir 2 by insulating means.

Some examples of types of filling machines which provide additional operation aspects thereof, as well as components and accessories which can be used in conjunction with the present invention are disclosed by the following U.S. Patents: U.S. Pat. No. 5,119,853 entitled "Apparatus for Filling Cans With a Liquid", U.S. Pat. No. 5,042,536 entitled "Can Filling Apparatus Having a Vent Tube Movable Relative to a Fill Tube", U.S. Pat. No. 5,040,574 entitled "Can Filling Apparatus Having an Improved Gas Venting Mechanism", and U.S. Pat. No. 4,938,261 entitled "Apparatus for Filling Cans With a Liquid", each of which has the inventors Petri, Rademacher and Sindermann (an inventor of the present invention); U.S. Pat. No. 4,679,603 entitled "Filling Machine for Filling Liquid Under Counterpressure", and U.S. Pat. No. 4,635,690 entitled "Filling Valve for Use in the Bottling of Liquids", both of which have the inventors Rademacher, Sindermann and Sushardt; U.S. Pat. No. 3,908,717 to Rademacher et al., entitled "Apparatus for Filling Beer Cans or the Like"; and U.S. Pat. No. 3,889,725 to Rademacher et al., entitled "Method of Filling Beer Cans or the Like".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 03 524.8, filed on Feb. 6, 1993, having inventors Heinz-Michael Zwilling, Siegmar Sindermann and Axel Theine, and DE-OS P 43 03 524.8 and DE-PS P 43 03 524.8, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. In a container filling machine for filling liquid into containers, the containers having an interior space, the container filling machine having a liquid supply, and said filling machine comprising:

means for receiving a container, said means for receiving a container comprising seal means for sealing the interior space of a container from the surrounding atmosphere;

means for moving one of:

said means for receiving, and a container, towards and away from the other of:

said means for receiving, and a container to respectively engage and disengage said seal means and a container;

fill conduit means interconnecting said liquid supply with a container sealed to said means for receiving, said conduit means being configured for conducting liquid from said liquid supply to the container sealed to said means for receiving;

a valve body for opening and closing said conduit means to respectively permit and stop liquid flow into the container;

means for operating said valve body to open and close the conduit means;

said valve body comprising a gas exchange tube for at least conducting gas out of the container as liquid flows into the container;

said gas exchange tube being configured to be movable relative to said valve body, and said gas exchange tube comprising first biasing means for biasing said valve body into its closed position with a first biasing force; and said means for operating said valve body comprising:

means for overcoming said first biasing force to open the valve body in the presence of a container sealed to said means for receiving; and means for maintaining said valve body in a closed position in the absence of a container sealed to said means for receiving;

the liquid supply comprises a reservoir having a liquid therein, the reservoir having a gas headspace above the liquid, and a gas in the gas headspace, the gas being pressurized;

said valve body comprises a first end disposed adjacent the container, and a second end disposed away from the container, said second end comprising a cylindrical extension extending from said first end, and said valve body defining a longitudinal dimension from said first end to said second end;

said gas exchange tube is disposed through said valve body in a direction along said longitudinal dimension;

said gas exchange tube having a first end disposed adjacent the first end of the valve body, and a second end extending away from the second end of the valve body into the headspace of the reservoir;

said gas exchange tube having a first position with the first end disposed within the valve body, and a second position with the first end thereof disposed extended away from the first end of the valve body;

said gas exchange tube being configured to be held in the first position by the gas pressure within the reservoir in the absence of a container sealed to said means for receiving; and said gas exchange tube comprises a first flange, and said valve body comprises a second flange, said first flange and said second flange comprising stop means for preventing opening of said valve body by said means for operating said valve body in the absence of a container.

2. The filling machine according to claim 1, wherein:

said gas exchange tube is disposed concentrically within said valve body;

said gas exchange tube is configured to be movable into the second position in the presence of a container sealed to said receiving means;

said first and second flange means, with said gas exchange tube in said second position being spaced apart from one another for permitting movement of said valve body relative to said gas exchange tube; and said means for overcoming said first biasing force comprises:

sleeve means disposed concentrically about at least a portion of said second end of said valve body, said second end of said valve body being moveable within said sleeve means;

second biasing means for biasing said sleeve means away from said second end of said valve body with a second biasing force, said second biasing means having a greater prestress than said first biasing means; and cam means configured for depressing said sleeve means about said second end of said valve body to compress said second biasing means to increase said second biasing force to an amount greater than said first biasing force to open said valve means in the presence of a container sealed to said means for receiving.

3. The filling machine according to claim 2, wherein said cam means comprises a cam portion configured for contacting said sleeve means to depress said sleeve means about the second end of said valve body to open the valve body, and for releasing pressure on said sleeve means to allow said sleeve means to move away from the second end of the valve body, said first biasing means being configured for closing the valve body from the open position after the cam pressure has been released.

4. The filling machine according to claim 3, wherein said cam portion is further configured for raising said gas exchange tube from said second position back to said first position against the first biasing force of said first biasing means.

5. The filling machine according to claim 4, wherein:

the reservoir has an upper plate defining a top of the reservoir;

the second end of the gas exchange tube in the first position of the gas exchange tube is configured to seal against the upper plate of the reservoir;

the second end of said gas exchange tube comprises sealing plate for sealing against the upper plate of the reservoir; and said cam means is configured to engage said sealing plate to move said gas exchange tube from the second position to the first position after a container has been filled with liquid and the valve body has been closed.

6. The filling machine according to claim 5, wherein:

the upper plate of the reservoir comprises valve means, said valve means comprising:

a first gas passage for being aligned with the second end of the gas exchange tube;

a second gas passage in communication with the reservoir headspace; and a third gas passage in communication with a gas supply source;

said valve means being configured for opening and closing said first passage, and connecting at least one of:

said second passage and said third passage with said first passage.

7. The filling machine according to claim 6, wherein:

said receiving means comprises a further valve means for opening the interior space of the container sealed to said receiving means to the surrounding atmosphere; and the gas supply source comprises a supply for providing a purging gas for purging air from a container sealed to said receiving means; and said first passage and said third passage of said valve means, said gas exchange tube, and said further valve means open to the atmosphere define a gas passage for supplying purging gas to a container sealed to said receiving means.

8. The filling machine according to claim 7, wherein:

said valve means comprises at least one additional passage for connecting said first passage to a means for providing a sterilization medium to a container sealed to said receiving means;

said means for providing a sterilization medium comprises one of:

a chamber disposed adjacent said liquid reservoir; and a chamber disposed in a spaced apart relationship to said liquid reservoir by insulating means to prevent heat from the sterilization chamber from heating the liquid reservoir.

9. The filling machine according to claim 8, wherein:

said filling machine is for filling open-top cans and bottles;

said filling machine comprises a cylinder having a diameter, a height and a circumferential portion, with the diameter of the cylinder being substantially greater than a height thereof;

said reservoir comprises a toroidal chamber disposed about the cylinder adjacent the circumferential portion thereof;

said filling machine comprises a plurality of container filling stations disposed about the circumferential portion thereof, each said container filling station comprising one of said valve body, said gas exchange tube and said means for receiving a container;

said filling machine further comprises a turntable for holding containers thereon relative to each said means for receiving for each filling station;

each said means for receiving comprises a centering bell for centering containers relative to each said valve body;

said means for moving one of: said means for receiving and a container comprises means for lowering said centering bells to engage containers disposed therebelow on said turntable;

said filling machine has an exterior disposed about the circumferential portion thereof, and said filling machine further comprises a rotary pinion gear disposed exterior to said filling machine for controlling operation of said cam means;

said filling machine further comprises rail means disposed exterior to said filling machine for controlling operation of said valve means and said further valve means;

said fill conduit means comprises a tubular extension interconnecting said reservoir with said means for receiving a container;

said valve body and said gas exchange tube being disposed concentrically within said fill conduit means;

said first and second flanges further comprising guides for guiding movement of said valve body and said gas exchange tube within said fill conduit means;

said fill conduit means comprising a third flange for engaging said first flange of said gas exchange tube to limit movement of said gas exchange tube during movement of said gas exchange tube from said first position to said second position;

said first end of said gas exchange tube in said second position of said gas exchange tube define a fill level for liquid in containers sealed to said means for receiving;

said first end of said gas exchange tube comprises a check valve for inhibiting fluid flow into said gas exchange tube;

said gas exchange tube has an opening at said first end and said check valve comprising a float for blocking said opening of said first end of said gas exchange tube;

said cylindrical extension of said valve body has an interior surface and an exterior surface;

said gas exchange tube comprises further flange means extending from said gas exchange tube to said interior surface of said cylindrical extension;

said second end of said valve body comprises a ring-shaped member disposed within said cylindrical extension;

said first biasing means comprises a first spring disposed adjacent the interior surface of said cylindrical extension under a prestress between said ring-shaped member and said further flange means of said gas exchange tube;

said cylindrical extension comprises a second ring-shaped member disposed about the exterior surface thereof and spaced apart from said second end;

said second biasing means comprises a second spring disposed about the exterior surface of said cylindrical extension under a prestress between said sleeve means and said second ring-shaped member;

said sleeve means and the second end of said valve body comprising stop means for limiting movement of said sleeve means away from said second end of said valve body;

said fill conduit means comprises a first end disposed adjacent said first end of said valve body means;

said first end of fill conduit means comprising a valve seat disposed in a direction towards the containers to be filled;

said first end of said valve body comprises a ring-shaped flange extending away from said valve body, said ring shaped flange having a first surface disposed towards said valve seat, and a second surface disposed towards the containers to be filled; and said first surface of said ring-shaped flange comprising gasket means for sealing said ring-shaped flange to said valve seat to seal said valve body to said fill conduit means in said closed position of said valve body.

10. A filling valve for a container filling machine for filling liquid into containers, the containers having an interior space, the container filling machine comprising a reservoir to contain liquid therein with a gas headspace above the liquid, means for supporting containers to be filled relative to the reservoir, and means for providing a gas to purge a container to be filled, said filling valve comprising:

fill conduit means configured for interconnecting the reservoir with a container to be filled;

a valve body for opening and closing said conduit means to respectively permit and stop liquid flow into a container;

said valve body comprising a gas exchange tube for conducting gas into and out of a container;

said gas exchange tube having a first end disposed adjacent a container to be filled, and a second end disposed within the reservoir;

said gas exchange tube being configured to be movable relative to, and independently of said valve body, between a first position and a second position;

said gas exchange tube in said first position comprising said second end thereof in communication with said means for providing a purging gas to purge the container to be filled; and said gas exchange tube in said second position comprising said second end in communication with the gas headspace for venting gas out of a container being filled into the headspace of the reservoir during liquid flow into the container being filled.

11. The filling valve according to claim 10, wherein said filling machine further comprises means for receiving containers to be filled for positioning the containers to be filled with respect to said fill conduit means, said filling valve further comprising:

seal means for sealing containers to said fill conduit means to seal the interior space of the container from the surrounding atmosphere;

first biasing means disposed between said gas exchange tube and said valve body for biasing said valve body into its closed position with a first biasing force; and means for operating said valve body against said first biasing force to open and close the conduit means.

12. The filling valve according to claim 11, wherein:

the gas headspace comprises a gas under pressure;

the reservoir has an upper plate defining a top of the reservoir, the upper plate of the reservoir comprises valve means, said valve means comprising:

a first gas passage for being aligned with the second end of the gas exchange tube;

a second gas passage in communication with the reservoir headspace; and a third gas passage in communication with said means for providing a purging gas;

the second end of said gas exchange tube comprises sealing means for sealing against the upper plate of the reservoir;

said valve body comprises a first end disposed adjacent the container, and a second end disposed away from the container within the reservoir, said second end comprising a cylindrical extension extending from said first end, and said valve body defining a longitudinal dimension from said first end to said second end;

said gas exchange tube is disposed through said valve body in a direction along said longitudinal dimension;

said gas exchange tube in said first position comprising its first end disposed within the valve body and its second end sealed against the upper plate of the reservoir in sealed communication with said first gas passage;

said gas exchange tube in said second position comprising its first end disposed extended away from the first end of the valve body into a container to be filled, and its second end spaced away from the upper plate of the reservoir; and said valve means being configured for opening and closing said first passage, and connecting at least one of:

said second passage and said third passage with said first passage and said gas exchange tube.

13. The filling valve according to claim 12, further including:

said means for receiving comprising a further valve means for opening the interior space of the container sealed to said conduit means to the surrounding atmosphere; and said first passage and said third passage of said valve means, said gas exchange tube, and said further valve means open to the atmosphere define a gas passage for supplying the purging gas to a container sealed to said conduit means.

14. The filling valve according to claim 13, further comprising:

said gas exchange tube being configured to be held in the first position by the gas pressure within the reservoir in the absence of a container sealed to said conduit means;

said gas exchange tube comprising a first flange, and said valve body comprising a second flange disposed adjacent said first flange of said gas exchange tube;

said means for operating said valve body comprising:

means for overcoming said first biasing force to open the valve body in the presence of a container sealed to said conduit means; and means for maintaining said valve body in a closed position in the absence of a container sealed to said conduit means, said means for maintaining comprising said first and second flanges, said first flange comprising stop means for preventing movement of said valve body to open said conduit means in the absence of a container sealed to said conduit means.

15. The filling valve according to claim 14, wherein:

said gas exchange tube is disposed concentrically within said valve body;

said gas exchange tube is configured to be movable into the second position in the presence of a container sealed to said conduit means;

said first and second flange means, with said gas exchange tube in said second position being spaced apart from one another for permitting movement of said valve body relative to said gas exchange tube to open said valve body in the presence of a container sealed to said conduit means; and said means for overcoming said first biasing force comprises:

sleeve means disposed concentrically about at least a portion of said second end of said valve body, said second end of said valve body being moveable within said sleeve means;

second biasing means for biasing said sleeve means away from said second end of said valve body with a second biasing force, said second biasing means having a greater prestress than said first biasing means; and cam means configured for depressing said sleeve means about said second end of said valve body to compress said second biasing means to increase said second biasing force to an amount greater than said first biasing force to open said valve means in the presence of a container sealed to said conduit means.

16. The filling valve according to claim 15, wherein:

said cam means comprises a cam portion configured for contacting said sleeve means to depress said sleeve means about the second end of said valve body to open the valve body, and for releasing pressure on said sleeve means to allow said sleeve means to move away from the second end of the valve body, said first biasing means being configured for closing the valve body from the open position after the cam pressure has been released;

said sealing means of said second end of said gas exchange tube comprises a sealing plate;

said cam means is further configured to engage said sealing plate to move said gas exchange tube from the second position to the first position after a container has been filled with liquid and the valve body has been closed;

said valve means of said upper plate comprises at least one additional passage for connecting said first passage to a means for providing a sterilization medium to a container sealed to said receiving means;

said means for providing a sterilization medium comprises one of:

a chamber disposed adjacent said liquid reservoir; and a chamber disposed in a spaced apart relationship to said liquid reservoir by insulating means to prevent heat from the sterilization chamber from heating the liquid reservoir;

said filling machine is for filling open-top cans and bottles;

said filling machine comprises a cylinder having a diameter, a height and a circumferential portion, with the diameter of the cylinder being substantially greater than a height thereof;

said reservoir comprises a toroidal chamber disposed about the cylinder adjacent the circumferential portion thereof;

said filling machine comprises a plurality of container filling stations disposed about the circumferential portion thereof, each said container filling station comprising one of said valve body, said gas exchange tube and said means for receiving a container;

said means for supporting a container comprises a turntable for holding containers thereon relative to each said means for receiving for each filling station;

each said means for receiving comprises a centering bell for centering containers relative to each said valve body;

said valve means further comprises means for lowering said centering bells to engage containers disposed therebelow on said turntable;

said filling machine has an exterior disposed about the circumferential portion thereof, and said filling machine further comprises a rotary pinion gear disposed exterior to said filling machine for controlling operation of said cam means;

said filling machine further comprises rail means disposed exterior to said filling machine for controlling operation of said valve means and said further valve means;

said fill conduit means comprises a tubular extension interconnecting said reservoir with said means for receiving a container;

said valve body and said gas exchange tube being disposed concentrically within said fill conduit means;

said first and second flanges further comprising guides for guiding movement of said valve body and said gas exchange tube within said fill conduit means;

said fill conduit means comprising a third flange for engaging said first flange of said gas exchange tube to limit movement of said gas exchange tube during movement of said gas exchange tube from said first position to said second position;

said first end of said gas exchange tube in said second position of said gas exchange tube define a fill level for liquid in containers sealed to said means for receiving;

said first end of said gas exchange tube comprises a check valve for inhibiting fluid flow into said gas exchange tube;

said gas exchange tube has an opening at said first end and said check valve comprising a float for blocking said opening of said first end of said gas exchange tube;

said cylindrical extension of said valve body has an interior surface and an exterior surface;

said gas exchange tube comprises further flange means extending from said gas exchange tube to said interior surface of said cylindrical extension;

said second end of said valve body comprises a ring-shaped member disposed within said cylindrical extension;

said first biasing means comprises a first spring disposed adjacent the interior surface of said cylindrical extension under a prestress between said ring-shaped member and said further flange means of said gas exchange tube;

said cylindrical extension comprises a second ring-shaped member disposed about the exterior surface thereof and spaced apart from said second end;

said second biasing means comprises a second spring disposed about the exterior surface of said cylindrical extension under a prestress between said sleeve means and said second ring-shaped member;

said sleeve means and the second end of said valve body comprising stop means for limiting movement of said sleeve means away from said second end of said valve body;

said fill conduit means comprises a first end disposed adjacent said first end of said valve body means;

said first end of fill conduit means comprising a valve seat disposed in a direction towards the containers to be filled;

said first end of said valve body comprises a ring-shaped flange extending away from said valve body, said ring shaped flange having a first surface disposed towards said valve seat, and a second surface disposed towards the containers to be filled; and said first surface of said ring-shaped flange comprising gasket means for sealing said ring-shaped flange to said valve seat to seal said valve body to said fill conduit means in said closed position of said valve body.

17. A filling valve for a container filling machine for filling liquid into containers, the containers having an interior space, the container filling machine comprising a reservoir to contain liquid therein with a gas headspace above the liquid, means for supporting containers to be filled relative to the reservoir, said filling valve comprising:

fill conduit means interconnecting said liquid supply with a container sealed to said means for receiving, said conduit means being configured for conducting liquid from said liquid supply to the container sealed to said means for receiving;

seal means for sealing a container to be filled to said fill conduit means;

a valve body for opening and closing said conduit means to respectively permit and stop liquid flow into the container;

means for operating said valve body to open and close the conduit means;

said valve body comprising a gas exchange tube for at least conducting gas out of the container as liquid flows into the container;

said gas exchange tube being configured to be movable relative to said valve body, and said gas exchange tube comprising first biasing means for biasing said valve body into its closed position with a first biasing force;

said means for operating said valve body comprising:

means for overcoming said first biasing force to open the valve body in the presence of a container sealed to said conduit means; and means for maintaining said valve body in a closed position in the absence of a container sealed to said conduit means;

said valve body comprises a first end disposed adjacent the container, and a second end disposed away from the container, said second end comprising a cylindrical extension extending from said first end, and said valve body defining a longitudinal dimension from said first end to said second end;

said gas exchange tube is disposed concentrically within and through said valve body in a direction along said longitudinal dimension;

said gas exchange tube having a first end disposed adjacent the first end of the valve body, and a second end extending away from the second end of the valve body into the headspace of the reservoir;

said gas exchange tube having a first position with the first end disposed within the valve body, and a second position with the first end thereof disposed extended away from the first end of the valve body;

said gas exchange tube being configured to be held in the first position by the gas pressure within the reservoir in the absence of a container sealed to said conduit means;

said gas exchange tube comprises a first flange, and said valve body comprises a second flange, said first flange and said second flange comprising stop means for preventing opening of said valve body by said means for operating said valve body in the absence of a container;

said gas exchange tube is configured to be movable into the second position in the presence of a container sealed to said receiving means;

said first and second flange means, with said gas exchange tube in said second position being spaced apart from one another for permitting movement of said valve body relative to said gas exchange tube;

said means for overcoming said first biasing force comprises:

sleeve means disposed concentrically about at least a portion of said second end of said valve body, said second end of said valve body being moveable within said sleeve means;

second biasing means for biasing said sleeve means away from said second end of said valve body with a second biasing force, said second biasing means having a greater prestress than said first biasing means; and cam means configured for depressing said sleeve means about said second end of said valve body to compress said second biasing means to increase said second biasing force to an amount greater than said first biasing force to open said valve means in the presence of a container sealed to said conduit means.

18. The filling machine according to claim 17, wherein said cam means comprises a cam portion configured for:

contacting said sleeve means to depress said sleeve means about the second end of said valve body to open the valve body, and for releasing pressure on said sleeve means to allow said sleeve means to move away from the second end of the valve body, said first biasing means being configured for closing the valve body from the open position after the cam pressure has been released; and raising said gas exchange tube from said second position back to said first position against the first biasing force of said first biasing means.

* * * * *